US009867481B2

(12) United States Patent
Shumway

(10) Patent No.: US 9,867,481 B2
(45) Date of Patent: Jan. 16, 2018

(54) CHANGING SURFACE SECURING DEVICE

(71) Applicant: Stephanie Ann Shumway, Boulder Creek, CA (US)

(72) Inventor: Stephanie Ann Shumway, Boulder Creek, CA (US)

(73) Assignee: Stephanie A. Shumway, Boulder Creek, CA (US)

( * ) Notice: Subject to any disclaimer, the term of this patent is extended or adjusted under 35 U.S.C. 154(b) by 0 days.

(21) Appl. No.: 15/483,975

(22) Filed: Apr. 10, 2017

(65) Prior Publication Data

US 2017/0295952 A1 Oct. 19, 2017

Related U.S. Application Data

(60) Provisional application No. 62/324,717, filed on Apr. 19, 2016.

(51) Int. Cl.
*A47D 15/00* (2006.01)
*A47D 5/00* (2006.01)

(52) U.S. Cl.
CPC ..... *A47D 15/005* (2013.01); *A47D 5/00* (2013.01)

(58) Field of Classification Search
CPC ..... A47D 15/00; A47D 15/005
USPC ..... 5/655, 420, 947
See application file for complete search history.

(56) References Cited

U.S. PATENT DOCUMENTS 4,712,258 A * 12/1987 Eves ..... A47D 5/006 5/420

* cited by examiner

*Primary Examiner* — Frederick Conley

(57) ABSTRACT

Some embodiments of the present disclosure include a device for securing a baby to a changing pad and/or surface. The device may include an adjustable strap configured to encircle the changing pad and/or surface; and an adjustable wrap attached to the strap, the wrap configured to wrap around a torso of the baby, securing the baby in place on the changing pad and/or surface.

1 Claim, 3 Drawing Sheets

CHANGING SURFACE SECURING DEVICE

BACKGROUND

The embodiments described herein relate to baby accessories and, more particularly, to a device to secure a baby onto a changing pad and/or surface.

Babies are restless and tend to squirm when their diapers are being changed, which has the potential to result in a child falling off of the changing pad and/or table, causing injury. Conventional devices to secure a baby to a changing pad and/or surface include a belt with a buckle, but the belts are not comfortable or warm for a baby and also are not always effective.

Therefore, what is needed is a universal changing pad and/or surface securing device that is effective for the majority of babies and changing pads and/or surfaces.

SUMMARY

Some embodiments of the present disclosure include a device for securing a baby to a changing pad and/or surface. The device may include an adjustable strap configured to encircle the changing pad and/or surface; and an adjustable wrap attached to the strap, the wrap configured to wrap around a torso of the baby, securing the baby in place on the changing pad and/or surface.

BRIEF DESCRIPTION OF THE FIGURES

Having thus described the invention in general terms, reference is now made to the accompanying figures, which show different views of different example embodiments.

Figure 1:
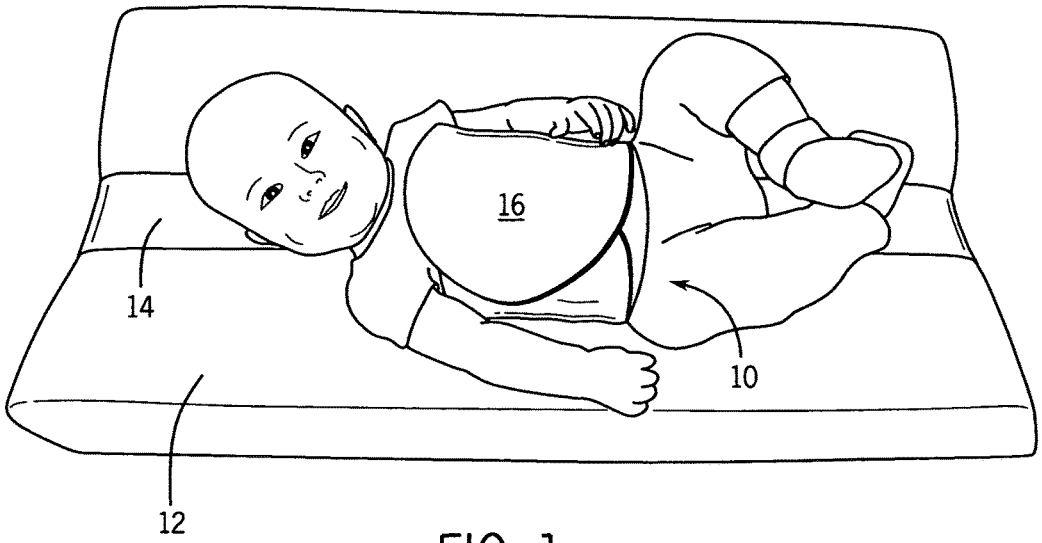

FIG. 1 is a view of the invention in use with a baby held securely to a changing pad and/or surface. The strap of the invention encircles the changing pad and/or surface. The wrap, that is attached to the strap, encompasses the baby's torso.

Figure 2:
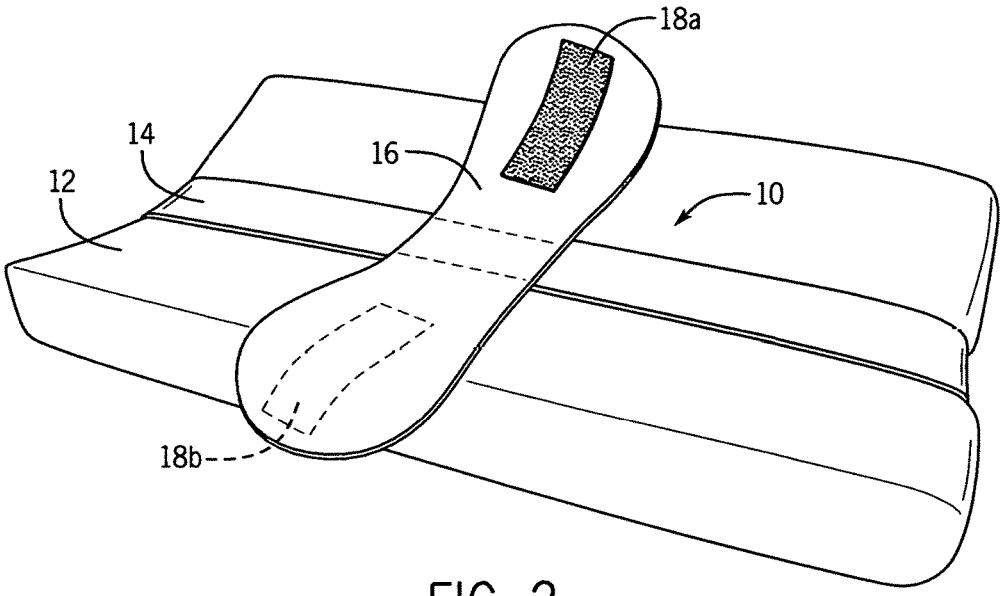

FIG. 2 is a similar view to FIG. 1 but shows the invention encircling the changing pad and/or surface when not in use. The attached wrap is open and the wrap fasteners are visible.

Figure 3:
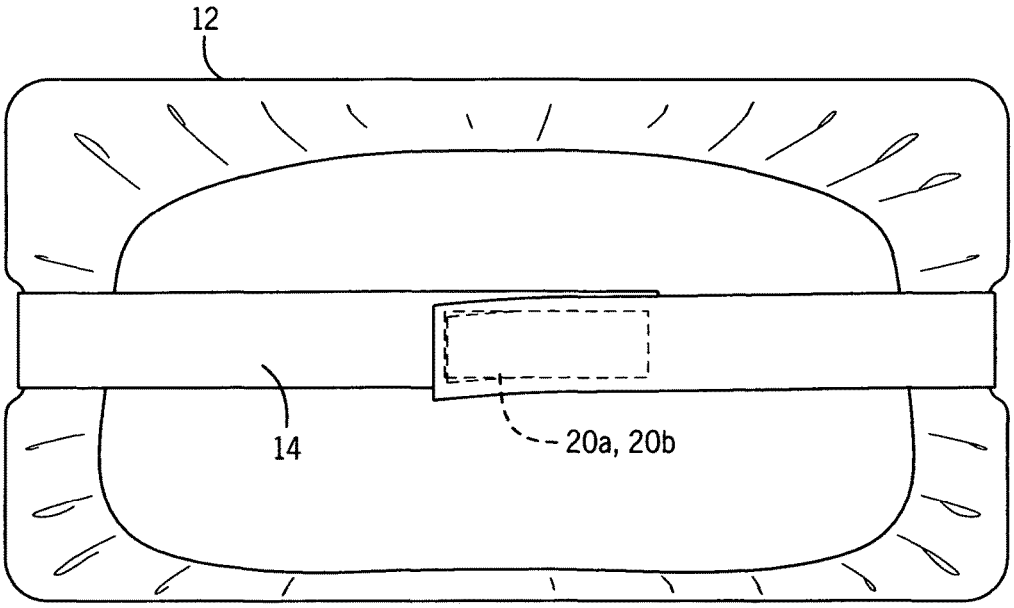

FIG. 3 is a view of the invention and the strap fasteners from underneath the changing pad and/or surface. The invention is encircling and secured to the changing pad and/or surface with the fasteners.

Figure 4:
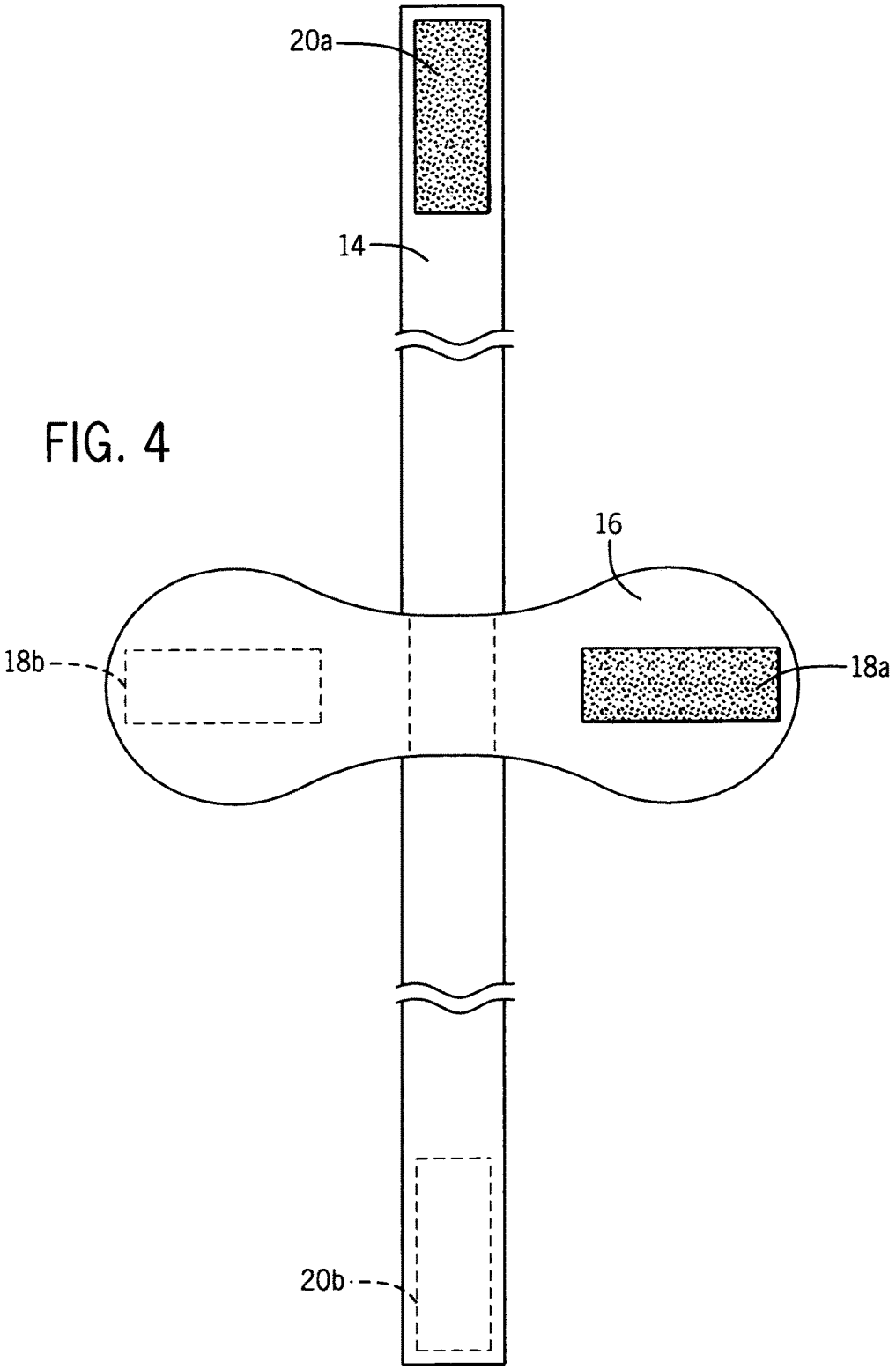

FIG. 4 is a view of the invention itself. The invention comprised of an adjustable strap with fasteners and an attached adjustable wrap with fasteners.

DETAILED DESCRIPTION

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used to secure a baby to a changing pad and/or surface and may be comprised of the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

1. Strap
2. Wrap
3. Fasteners

The various elements of the device of the present invention may be related in the following exemplary fashion. It is not intended to limit the scope or nature of the relationships between the various elements and the following examples are presented as illustrative examples only.

By way of example, and referring to FIGS. 1-4, some embodiments of the invention include a device 10 for securing a baby to a changing pad and/or surface, the device 10 comprising an adjustable strap 14 configured to encircle a changing pad and/or surface 12, and an adjustable wrap 16 attached to the strap 14, the wrap 16 configured to wrap around the torso of a baby, securing the baby in place on the changing pad and/or surface 12. In embodiments, the strap 14 may run lengthwise around the changing pad and/or surface 12, as shown in FIGS. 1-3, and the wrap 16 may be attached to the strap 14 such that the length of the wrap 16 is perpendicular to the length of the strap 14.

As shown in the Figures, the strap 14 may have a first end and a second end, each end having a fastener configured to engage with a fastener on the other end. For example, in some embodiments, the first end may comprise a hook fastener 20*a*, while the second end may comprise a loop fastener 20*b*. The hook fastener 20*a* may be configured to engage with the loop fastener 20*b* in an adjustable manner, such that the strap 14 may fit around changing pads and/or surfaces 12 of varying sizes. In embodiments, the strap 14 may be substantially rectangular in shape.

Similar to the strap 14, the wrap 16 may have a first end and a second end, each end having a fastener configured to engage with a fastener on the other end. For example, in some embodiments, the first end may comprise a hook fastener 18*a*, while the second end may comprise a loop fastener 18*b*. The hook fastener 18*a* may be configured to engage with the loop fastener 18*b* in an adjustable manner, such that the wrap 16 may fit around babies of varying sizes. In embodiments, the wrap 16 may be substantially rounded hour-glass shaped.

To use the device 10 of the present disclosure, a user may wrap the strap 14 lengthwise around the changing pad and/or surface 12, securing the strap 14 in place using the fasteners and positioning the fasteners on the underside of the changing pad and/or surface 12. As a result, the wrap 16 should be positioned on a top surface of the changing pad and/or surface 12. A baby may then be placed on the changing pad and/or surface 12, and the wrap 16 may be wrapped around the baby's torso, being secured in place using the fasteners. The user may then change the baby's diaper as normal.

While the device 10 of the present disclosure is described as being used with a changing pad and/or surface 12, it is not limited to such a use. In fact, the device 10 of the present disclosure may be used with any hard or soft surface having dimensions that fit within the strap 14.

The device 10 of the present disclosure may be made using any desired materials and, in some embodiments, is made using cotton and polyester. Moreover, while the device 10 is described above as including hook and loop fasteners, any conventional fasteners may be used.

The above-described embodiments of the invention are presented for purposes of illustration and not of limitation. While these embodiments of the invention have been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claims.

What is claimed is:

1. A device for securing a baby to a changing pad and/or surface by attaching the device to a changing pad and/or surface and subsequently securing the baby with the device, the device comprising:

an adjustable strap with fasteners on either end configured to encircle the longitudinal axis of the changing pad and/or surface, and thus, the strap, once fastened, attaches the device to the changing pad and/or surface; and an adjustable wrap that is permanently attached to the strap such that the wrap's longitudinal axis is transverse or perpendicular to the longitudinal axis of the strap, and is configured to bind around the torso of a baby, securing the baby in place on the changing pad and/or surface.

* * * * *